United States Patent [19]

Aizawa

[11] Patent Number: 4,978,998

[45] Date of Patent: Dec. 18, 1990

[54] IMAGE TRANSFERRING DEVICE FOR IMAGE FORMING EQUIPMENT

[75] Inventor: Hideo Aizawa, Tokyo, Japan

[73] Assignee: Ricoh Company, Ltd., Tokyo, Japan

[21] Appl. No.: 512,150

[22] Filed: Apr. 20, 1990

[30] Foreign Application Priority Data

Apr. 24, 1989 [JP] Japan ..... 1-101795
Feb. 20, 1990 [JP] Japan ..... 2-37462

[51] Int. Cl.[5] ..... G03G 15/14
[52] U.S. Cl. ..... 355/273; 355/271
[58] Field of Search ..... 355/273, 271, 274, 275, 355/276, 277, 278, 279, 280, 281

[56] References Cited

U.S. PATENT DOCUMENTS 3,784,300 1/1974 Hudson et al. ..... 355/273
4,039,257 8/1977 Connolly ..... 355/273
4,410,263 10/1983 Gustafson et al. ..... 355/275
4,482,240 11/1984 Kuge et al. ..... 355/274
4,538,901 9/1985 Soumiya ..... 355/273

FOREIGN PATENT DOCUMENTS 3314578 12/1988 Japan ..... 355/273

*Primary Examiner*—A. T. Grimley
*Assistant Examiner*—Sandra L. Hoffman
*Attorney, Agent, or Firm*—Oblon, Spivak, McClelland, Maier & Neustadt

[57] ABSTRACT

An image transferring device for use in image forming equipment prevents an image from being omitted in a trailing edge portion of a paper sheet in the event when pre-transfer discharge is applied to a photoconductive element prior to image transfer. The pre-transfer discharge is not effected on an image portion of a photoconductive element that is associated with a trailing edge portion of a paper sheet where a discharge due to separation will be caused by the vibration of the trailing edge portion of the paper sheet.

4 Claims, 4 Drawing Sheets

IMAGE TRANSFERRING DEVICE FOR IMAGE FORMING EQUIPMENT

BACKGROUND OF THE INVENTION

The present invention relates to an image transferring device for use in image forming equipment which prevents an image from being omitted in a trailing edge portion of a paper sheet despite the application of pre-transfer discharge to a photoconductive element prior to image transfer.

In an electrophotographic copier or similar image forming equipment using an electrophotographic procedure, it often occurs that a reproduction of a solid image has an irregular density distribution in the form of spots. To eliminate such an occurence, it has been customary to provide a pre-transfer lamp or similar pre-transfer discharger between a developing device and an image transfer station. The pre-transfer discharger discharges a photoconductive element prior to image transfer and thereby enhances efficient image transfer. Discharging the photoconductive element in advance at the image transferring stage, however, brings about a problem that a trailing edge portion of a paper sheet where an image should exist is apt to remain simply blank. Specifically, since the pre-transfer discharge increases the difference between the charge on the photoconductive element and the charge to be deposited on the paper sheet, even a slight vibration causes a discharge to occur at the image transfer station due to separation. As a result, the charge deposited on the paper sheet leaks to weaken the electrostatic attraction acting between the paper sheet and a toner, resulting in the omission of an image in the trailing edge portion of the paper sheet. While some efforts for eliminating the omission of an image discussed above have been reported, none of them is fully satisfactory.

SUMMARY OF THE INVENTION

It is therefore an object of the present invention to provide an image transferring device for image forming equipment which prevents an image from being omitted in a trailing edge portion of a paper sheet in the event when pre-transfer discharge is effected on a photoconductive element.

It is another object of the present invention to provide a generally improved image transferring device for image forming equipment.

A device for use in image forming equipment for transferring a toner image developed by a developing device on a photoconductive element to a paper sheet which is transported to an image transfer station by a register roller pair and guide member having a discontinuous portion of the present invention comprises a pre-transfer discharger adjoining the peripheral surface of the photoconductive element and located between the developing device and the image transfer station, and a transferring and separating unit for transferring the toner image to the paper sheet and separating the paper sheet from the photoconductive element. The pre-transfer discharger has been turned off when a leading edge portion of the paper sheet moves away from the discontinuous portion of the guide member and a portion of the photoconductive element that should reach the image transfer station moves away from a position where the pre-transfer discharger acts.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

To better understand the present invention, a brief reference will be made to a prior art image transferring device for image forming equipment.

Figure 1:
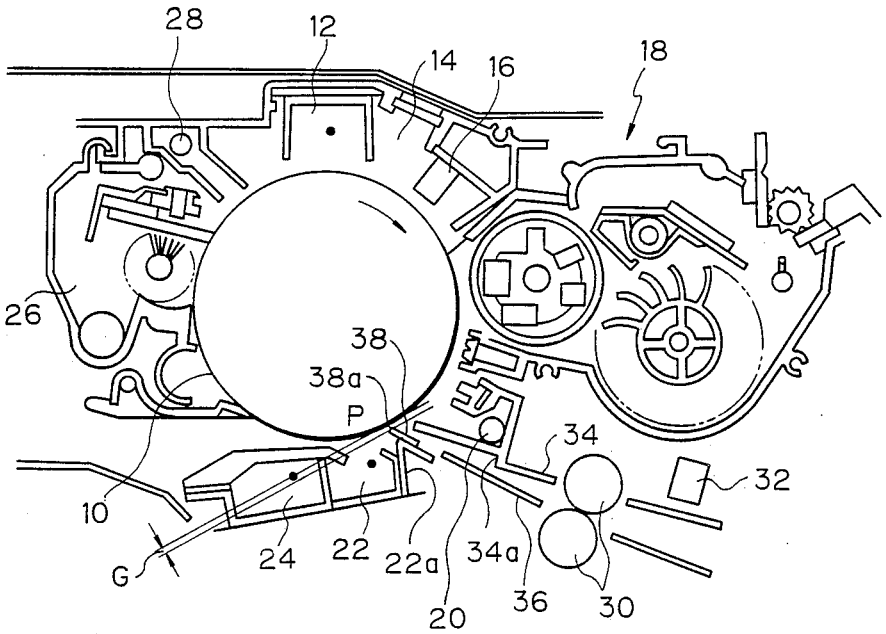
Fig. 1 PRIOR ART
FIG. 1 is a section showing a photoconductive drum of a conventional copier belonging to a family of image forming equipment of the type using a pre-transfer lamp as pre-transfer discharger, together with an arrangement around the drum.

FIG. 1 shows a part of an electrophotographic copier which belongs to a family of image forming equipment of the type using a pre-transfer lamp (PTL) as pre-transfer discharging means. As shown, the copier has a photoconductive drum 10 which plays the role of an image carrier. A main charger 12, optics 14 for exposure, an eraser 16, a developing unit 18, a PTL 20, a transfer charger 22, a separation charger 24, a cleaning unit 26 and a discharge lamp 28 are arranged around the drum 10 in this order with respect to an intended direction of rotation of the drum 10 which is indicated by an arrow in the figure. An image forming procedure implemented by these process units are conventional, and detailed description will be avoided for simplicity.

A register roller pair 30 is located on a paper transport path which extends through an image transfer station P defined between the transfer charger 22 and the drum 10. A register sensor 32 is positioned upstream of and immediately before the register roller pair 30. A paper sheet is fed toward the image transfer station P from a paper feeding device, not shown. As soon as the register sensor 32 senses the leading edge of the paper sheet, the register roller pair 30 is brought to a stop with coactive rollers thereof being pressed against each other. Hence, the register roller pair 30 is held in a stand-by condition with the leading edge of the paper sheet abutting against the inlet of a nip section of the roller pair 30. The register roller pair 30 starts rotating again at a predetermined timing which will allow the leading edge of the paper sheet to meet the leading edge of an image formed on the drum 10 at the image transfer station P. The paper sheet driven by the roller pair 30 is routed to the image transfer station P along a path defined by an upper and a lower guide plate 34 and 36. Located at the inlet of the image transfer station P is an inlet guide plate 38. The transfer charger 22 has a casing 22*a* to which the inlet guide plate 38 is rigidly connected. The tip of the guide plate 38 adjoins the drum 10 with a predetermined gap G defined between it and the drum 10. The guide plate 38 is implemented as a thin sheet made of an elastic material such as Mylar (tradename of polyehtylene telephthalate) and promotes close contact of the paper sheet with the drum 10 and, thereby, stable image transfer.

In the above construction, the PTL 20 discharges the drum 10 beforehand in order to enhance efficient image transfer from the drum 10 to the paper sheet. Discharging the drum 10 in advance at the image transferring stage, however, brings about a problem that a trailing edge portion of the paper sheet where an image should exist is apt to remain simply blank. Specifically, since the PTL 20 increases the difference between the charge on the drum 10 and the charge to be deposited on the paper sheet, even a slight vibration causes a discharge to occur at the image transfer station P due to separation. As a result, the charge deposited on the paper sheet leaks to weaken the electrostatic attraction acting between the paper sheet and the toner, resulting in the omission of an image in a trailing edge portion of the paper sheet.

Figure 2:
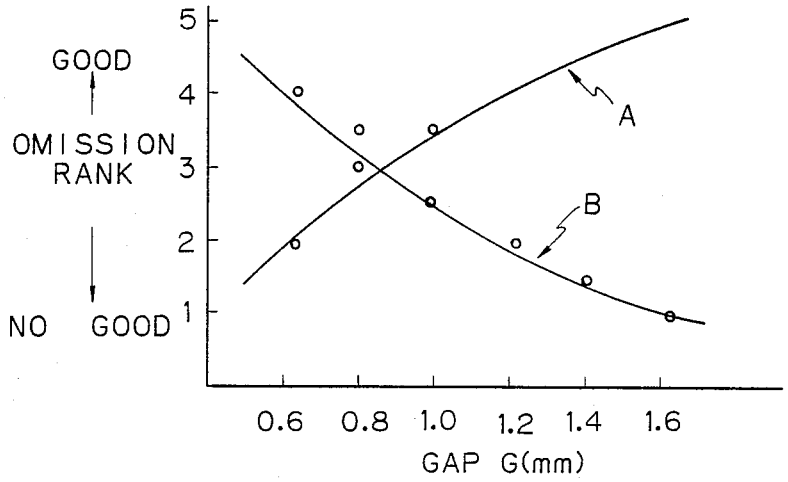
FIG. 2 is a graph showing a relationship between the gap defined between the drum of of FIG. 1 and an inlet guide plate and the omission of an image occurring in a leadin and a trailing edge portion of a paper sheet.

The gap G between the inlet guide plate 38 and the drum 10 has critical influence on the omission of an image in a leading and a trailing edge portion of a paper sheet. FIG. 2 is a graph showing a relationship between the gap G and the omission of an image in the leading and trailing edge portions of a paper sheet. In the graph, ranks 1, 2, 3, 4 and 5 indicate "no good", "nearly no good", "average", "good" and "very good", respectively. When the gap G is excessively small, the leading edge portion of a paper sheet will be bent in the event when the sheet enters the image transfer station P. Then, the leading edge of the paper sheet will fail to make close contact with the drum 10 and will, therefore, simply remain blank after image transfer, as indicated by a curve A in FIG. 2. Conversely, when the gap G is excessively large, a vibration will occur at the instant when the trailing edge of the paper sheet moves away from the tip 38*a* of the inlet guide plate 38. Then, a discharge ascribable to separation will occur at the image transfer station P to cause the charge on the paper sheet to leak. Consequently, the electrostatic attraction acting between the paper sheet and the toner will be weakened to omit an image which should be transferred to in the trailing edge portion of the paper sheet, as indicated by a curve B in FIG. 2.

Conversely speaking, the omission of an image at the trailing edge portion of a paper sheet may be suppressed to a certain extent if the gap G between the inlet guide plate 38 and the drum 10 is adjusted. However, as shown in FIG. 2, it is difficult to adjust the gap G in such a manner as to free both of the leading and trailing edge portions of a paper sheet from the omission of an image.

As shown in FIG. 1, the upper guide plat 34 is often provided with a shoulder 34*a* in order to accommodate the flexure or similar deformation of the paper sheet. The omission of an image in the leadin edge portion of a paper sheet also occurs in the event when the trailing edge portion being guided by the upper guide plate 34 moves away from the shoulder 34*a*.

Hereinafter will be described a preferred embodiment of the image transferring device in accordance with the present invention. In the figures, the same or similar components are designated by like reference numerals, and redundant description will be avoided for simplicity.

Figure 3:
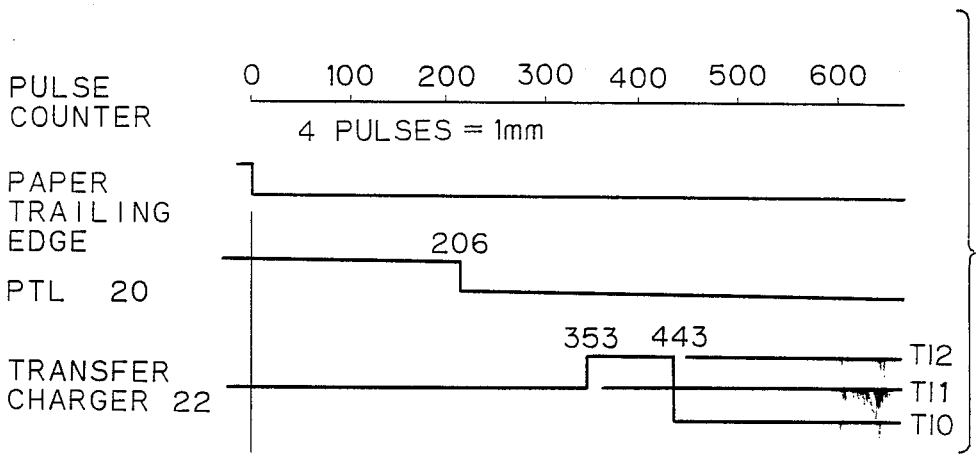
FIG. 3 is a timing chart demonstrating a timing at which a leading edge portion of a paper sheet will be sensed and the operation timings a pre-discharge lamp and a transfer charger particular to a preferred embodiment of the image transferring device in accordance with the present invention.
Figure 4:
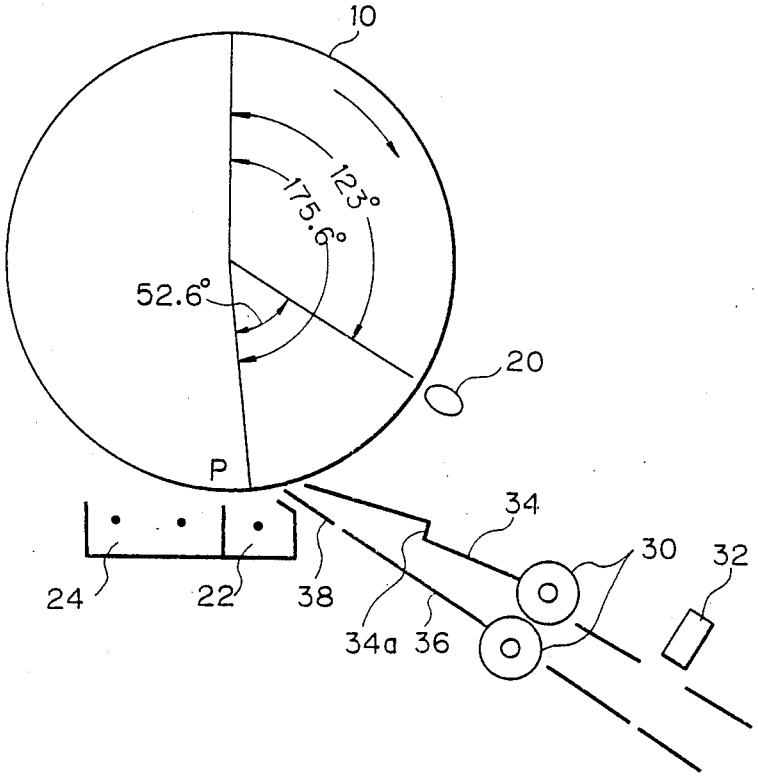
FIG. 4 is a diagram schematically showing a positional relationship between an image transfer station and some elements associated therewith particular to the illustrative embodiment.

FIG. 3 shows the timings for energizing a pre-transfer lamp or PTL 20 and a transfer charger 22 particular to the illustrative embodiment, in relation to the time at which the trailing edge of a paper sheet is sensed. The illustrative embodiment is shown in FIG. 4 together with some components and elements associated therewith. As shown, a paper sheet is driven by a register roller pair 30 to follow a transport path defined by an upper and a lower guide plate 34 and 36. As the transfer charger 22 is energized, a toner image is transferred from a photoconductive drum 10 to the paper sheet. The paper sheet carrying the toner image thereon is separated from the drum 10 by a separation charger 24 and then transported to an image fixing device, not shown. When the trailing edge of the paper sheet guided by and held in contact with the upper guide plate 34 moves away from a shoulder 34*a* of the upper guide plate 34, a vibration occurs to generate a discharged due to separation at the image transfer station P. This is one of the causes of the omission of an image. A vibration also occurs when the trailing edge of the paper sheet falls from the inlet guide plate 38, again resulting in the omission of an image.

The illustrative embodiment eliminates the omission of an image ascribable to the above causes by deenergizing the PTL or pre-transfer discharger 20 at an adequate timing. As FIG. 4 indicates, the distance between the register sensor 32 and the image transfer station P is $62.7+35.6=98.3$ millimeters, while the distance between the PTL 20 and the image transfer station P is $80\times3.14\times52.6/360=36.7$ millimeters (on the assumption that the drum 10 has a diameter of 80 millimeters). Assume that the trailing edge of a paper sheet has fallen from the inlet guide plate 38 to cause a vibration and thereby a discharge due to separation to occur. Then, an image would be omitted at a position of the paper sheet 8 millimeters away from the trailing edge. The illustrative embodiment eliminates this occurrence by turning off the PTL 20 at a timing corresponding to a position of the paper sheet 10 millimeters away from the trailing edge (see FIG. 3). Specifically, as soon as the register sensor 32 senses the trailing edge of a paper sheet, a pulse counter, not shown, is started. Although the distance between the register sensor 32 and the image transfer station P is 98.3 millimeters, the pulse counter counts up pulses the number of which corresponds to a distance of 88.3 millimeters because of the above-stated operation of the PTL 20. On the other hand, since the distance between the PTL 20 and the image transfer station P is 36.7 millimeters, the PT1 20 needs only to be turned off at a time later than the time when the register sensor 32 senses the trailing edge of the paper sheet by a period of time corresponding to a distance of 51.6 millimeters. In the illustrative embodiment, 1 millimeter corresponds to four pulses. Such timings are shown in FIG. 3.

As shown in FIG. 3, the transfer current applied to the transfer charger 22 is switched from $TI_1$ to $TI_2$ in response to the 353th pulse. This is to increase the transfer current for that part of the image which is not subjected to pre-transfer discharge.

Figure 5:
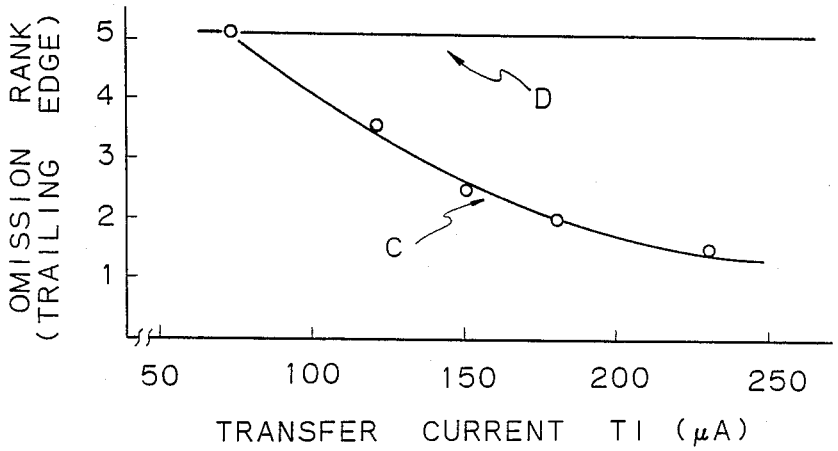
FIG. 5 is a graph showing a relationship between the transfer current and the omission of an image in a trailing edge portion of a paper sheet.

FIG. 5 is a graph representative of a relationship between the omission of an image in the trailing edge portion of a paper sheet and the transfer current TI. As a curve C indicates, when the pre-transfer discharge is effected, the rank sequentially lowers with the increase in the transfer current TI. On the other hand, when the pre-transfer discharge is not effected, a desirable rank is maintained with no regard to the transfer current TI.

Figure 6:
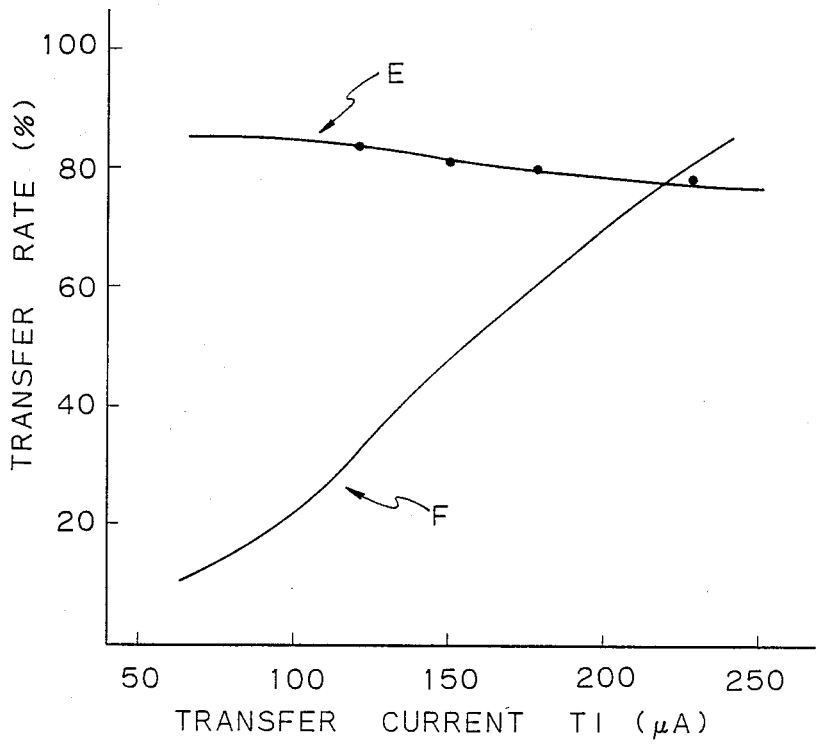
FIG. 6 is a graph indicative of a relationship between the transfer current and the transfer rate.

FIG. 6 shows a relationship between the transfer current TI and the image transfer rate. Concerning a solid image, a stable transfer rate is attainable if the pre-transfer discharge is turned on, as indicated by a curve E. However, when the pre-transfer discharge is not turned on, a stable transfer rate is not achieved unless the transfer current TI is greatly increased. In the light of this, the illustrative embodiment executes both of the turn-off of the PTL 20 and the switchover of the transfer current TI. This not only eliminates the omission of an image but also insures a stable transfer rate even with a solid image.

Of course, even the turn-off the PTL 20 alone is successful in eliminating the omission of an image in the trailing edge portion of a paper sheet and in providing a transfer rate which is acceptable in practice. The omission of an image in the trailing edge portion of a paper sheet is ascribable to the vibration of the paper sheet, as stated earlier. Usually, the omission rank is lower in a portion of a paper sheet closer to the image transfer station P than the other portion, and the PTL 20 may be turned off at a timing associated with such a portion of a paper sheen.

The omission rank mentioned above and the omission width depends on the material of a paper sheet, ambient conditions, etc. Preferably, therefore, the turn-off of the PTL 20 and the switchover of the transfer current TI should be effected in a plurality of steps with respect to timing.

In FIG. 3, the transfer current TI is turned off at a timing associated with the trailing edge plus some margin for the purpose of reducing the fatigue of the drum 10 ascribable due charging. The PTL 20 is shown as being turned off on the basis of the trailing edge portion of a paper sheet. Alternatively, an arrangement may be made such that the PTL 20 is turned off only in response to the trailing edge portion of a paper sheet and, immediately after or on the lapse of a short period of time after the passage of a portion of the drum 10 corresponding to the trailing edge portion of the paper sheet, turned on again. Such an arrangement will cause the drum 10 to fatigue evenly and is, therefore, desirable from the image quality standpoint.

In summary, in accordance with the present invention, even when pre-transfer charger is effected to enhance efficient image transfer, an image is prevented from being omitted in a trailing edge portion of a paper sheet. The present invention is, therefore, contributes a great deal to the improvement in the quality of an image.

Various modifications will become possible for those skilled in the art after receiving the teachings of the present disclosure without departing from the scope thereof.

What is claimed is:

1. A device for use in image forming equipment for transferring a toner image developed by a developing device on a photoconductive element to a paper sheet which is transported to an image transfer station by a register roller pair and guide means having a discontinuous portion, said device comprising:

pre-transfer discharging means adjoining a peripheral surface of the photoconductive element and located between the developing device and the image transfer station; and transferring and separating means for transferring the toner image to the paper sheet and separating said paper sheet from the photoconductive element;

said pre-transfer discharging means having been turned off when a leading edge portion of the paper sheet moves away from the discontinuous portion of the guide means and a portion of the photoconductive element that should reach the image transfer station moves away from a position where said pre-transfer discharging means acts.

2. A device as claimed in claim 1, wherein a timing for turning off said pre-transfer discharging means is deviated by a predetermined period of time from a timing at which a register sensor located immediately before the register roller pair will sense the leading edge portion of the paper sheet.

3. A device as claimed in claim 1, wherein a timing for turning off said pre-transfer discharging means is variable in a plurality of steps.

4. A device as claimed in claim 1, wherein a transfer current is increased at a timing for turning off said pre-transfer discharging means.

* * * * *